United States Patent [19]

Yoder

[11] Patent Number: 4,901,963

[45] Date of Patent: Feb. 20, 1990

[54] ADJUSTABLE CLAMP

[75] Inventor: Ronald L. Yoder, Topeka, Ind.

[73] Assignee: Universal Consolidated Methods, Inc., Topeka, Ind.

[21] Appl. No.: 747,122

[22] Filed: Jun. 20, 1985

[51] Int. Cl.[4] ..... B25B 5/00

[52] U.S. Cl. ..... 248/231.5; 24/514; 269/239; 269/249

[58] Field of Search ..... 248/643, 72, 228, 231.5, 248/231.7, 316.5; 269/238, 239, 249; 24/513, 514, 569

[56] References Cited

U.S. PATENT DOCUMENTS

| | | | |
|---|---|---|---|
| 804,342 | 11/1905 | Randall | 269/238 |
| 934,676 | 9/1909 | Langslow | 248/231.5 |
| 2,164,455 | 7/1939 | Hart | 269/239 |
| 2,182,480 | 12/1939 | Lowry | 269/238 |
| 2,726,693 | 12/1955 | Saxton | 269/239 |
| 2,985,174 | 5/1961 | Guth | 24/67.1 |
| 3,288,409 | 11/1966 | Bethea | 248/316.5 |
| 3,920,235 | 11/1975 | Hermanns | 269/238 |
| 4,147,257 | 4/1979 | Zippel | 211/45 |
| 4,161,735 | 7/1979 | Zylla . | |

FOREIGN PATENT DOCUMENTS

| | | | |
|---|---|---|---|
| 294394 | 7/1953 | Australia | 269/239 |
| 1477088 | 4/1967 | France | 269/239 |
| 81397 | 3/1953 | Norway | 248/231.5 |
| 650282 | 2/1951 | United Kingdom | 269/238 |

OTHER PUBLICATIONS

Server, F., "Pivoted Floating Clamp", American Machinist, Apr. 8, 1936, p. 313.

*Primary Examiner*—Ramon O. Ramirez
*Assistant Examiner*—Robert A. Olson
*Attorney, Agent, or Firm*—Roger M. Rickert

[57] ABSTRACT

An adjustable clamp is formed of two extrusions pivotally joined together by retaining structures consisting of a web and bead extruded as part of one of the extrusions and a channel extruded as part of the other extrusion and having sufficient cross-sectional size to receive the bead longitudinally. Edge portions of the channel define a gap wider than the web but narrower than the bead to allow limited pivotal movement of one extrusion relative to the other about an axis in the channel and to prevent the bead from slipping transversely out of the channel. One extrusion has a body portion with an arm extending from the body portion and a pressure pad on the arm. The other extrusion has a generally U-shaped configuration consisting of a bight and two sides, one of which has an edge with an extruded pressure pad thereon facing the pressure pad on the arm. The other side, which is adjacent the pivot axis defined by the bead and the channel, is juxtaposed with respect to the body portion of the othe extrusion. A bolt extends through a clearance hole in the outer one of these two juxtaposed components and threadedly engages a threaded hole in the other of the juxtaposed components to draw the juxtaposed body portion and the other side of the U-shaped extrusion toward each other and thus force the pressure pads toward each other.

2 Claims, 1 Drawing Sheet

ADJUSTABLE CLAMP

BACKGROUND OF THE INVENTION

Field of the Invention

This invention relates to adjustable clamps formed primarily of extrusions. In particular it relates to an adjustable clamp in which two extrusions are joined together by extruded portions thereof that serve as retaining members to hold the two extrusions together and also serve as a hinge structure that allows limited pivotal movement of the extrusions relative to each other. The pivotal operations is controlled by a bolt that extends through a clearance hole in one of the extrusions and threadedly engages a threaded hole in the other extrusion at a location so that tightening the bolt draws pressure pads on the two extrusions toward each other and, at the same time, draws the retaining members more firmly into engagement with each other.

The co-pending United States Patent Application of Samuel A. Hochstetler and Thomas R. Turner, Ser. No. 467,024, filed Feb. 16, 1983, describes an antenna clamp that includes two extrusions, one a flanged plate and other a locking plate, joined and hinged together by a bead along one edge of the locking plate and a partially closed slot on the flanged plate. One side of the slot is defined by an extruded ridge, and the other side by an extruded flap that extends part way around the bead and terminates close enough to the ridge so that the gap between the edge of the flap and the ridge is narrower than the width of the bead but greater than the thickness of that part of the locking plate adjoining the bead.

The first extrusion is free to pivot to a limited extent within the slot but can only be separated from the second extrusion by movement of the bead longitudinally along the slot. Such longitudinal movement is prevented, and the two extrusions are urged toward each other and into clamping engagement with the rain gutter on the automobile, by screws that pass through clearance holes in the flanged plate and engage threaded holes in the locking plate.

U.S. Pat. No. 4,147,257, issued Apr. 3, 1979 to Zippel, describes another extruded clamp comprising two essentially flat clamping plates that are essentially parallel to each other and spaced apart just enough to grip a pad of lamellar material between them. One of the plates has a flange along one edge to give it a J-shaped configuration, and the edge of this flange has an extruded channel to receive and to hold a bead extruded along one edge of the other clamping plate. The latter plate has a flange near the bead and extending perpendicularly from that plate, and a threaded shaft extends through clearance holes in the flanges on the two clamping plates. The shaft has a cross bar at one end to prevent it from rotating, and a wing nut screwed onto the other end to exert pressure on the clamp plates by way of the flanges.

U.S. Pat. No. 3,920,235 issued Nov. 18, 1975 to Hermanns describes another clamping structure in which the two main members are extruded and are provided with an integrally extruded retaining hinge comprising a bead along one edge of one of the clamping members and a matching channel in the other clamping member. However, instead of drawing the clamping members together by a suitably placed bolt, the clamping pressure between them is obtained by forcing them apart and in a direction such as to tend to pull the bead transversely out of the channel rather than to press it more firmly into the channel.

U.S. Pat. No. 2,182,480 issued Dec. 5, 1939 to Lowry shows still another clamp comprising two extruded members, both of which are generally L-shaped. Although pressure to apply clamping force between these two members is generated by a screw and nut arrangement that extends through matching parts of the L-shaped members, the screw is held by separate nuts that engage the respective members. Furthermore, the hinge that defines the axis for pivotal movement of one of the members relative to the other is formed only by a knife edge on one of the L-shaped members that rests in a V-shaped groove in the other. Thus, when there is no work piece to be grasped between the clamping surfaces, the two L-shaped members are not properly held in pivotal engagement with each other.

SUMMARY OF THE INVENTION

It is one of the objects of this invention to provide an improved adjustable clamp of simple contruction using two extruded members with an integrally formed retaining hinge comprising a bead along one member and a channel along the other and further comprising a bolt that passes through a clearance hole in one of the extrusions and threadedly engages a threaded hole in the other extrusion so that, except for the head, the bolt is substantially within the space enclosed by the clamp.

Another object is to provide an adjustable clamp suitable for attachment of a truck cap to the bed of a truck.

In accordance with this invention, an adjustable clamp is formed using two extrusions, one of which has a body portion and an arm extending from it, and the other of which has a generally U-shaped configuration. The extrusions are pivotally joined together by a retaining structure consisting of two retaining members, one of which is extruded integrally with the first extrusion and other other of which is extruded integrally with the second extrusion. One of the retaining members consists of a web and an enlarged bead along the edge of the web. The other retaining member is a channel large enough to receive the bead and to allow easy longitudinal motion of the bead in the channel but having a restricted gap defined by edge portions or flaps spaced apart by a distance greater than the thickness of the web but less than the width of the bead.

The U-shaped extrusion has two sides joined together by a bight. One of the sides has a pressure pad extruded along an edge thereof, and when the two extrusions are assembled together, this pressure pad is opposite a pressure pad on the arm of the other extrusion. The other side of the U-shaped extrusion and the body of the other extrusion have holes that are aligned when the extrusions are assembled. The hole in one of the extrusions is a clearance hole large enough to admit a bolt and to allow pivotal movement of the bolt, and the hole in the other extrusion is threaded to engage the threaded shaft of the bolt. The head of the bolt is too large to pass through the clearance hole, and tightening the bolt causes the extrusions to pivot with respect to each other in such a direction as to move the pressure pads toward each other, thereby allowing them to grip a work piece inserted between them.

While it has been common in the past to allow adjustable C-clamps to have a wide range of thickness of work pieces with which they may operate, the adjustable clamp of the present invention has a more limited range of adjustment, but that range can be extended by using extrusions of different configuration to space the pressure pads apart by different distances according to the work pieces to be gripped between these pads. In accordance with this invention, such variation of the range of operation can easily be accommodated by selecting the length of the body portion of the extrusion from which the arm extends so that the distance between the arm and the retaining member on that body portion is greater or less according to whether the clamp is to be used with a thicker or thinner work piece. More specifically, in the case of work pieces consisting of truck beds and truck caps, certain caps have rails that are an inch thick at the point where they are to be clamped to the lip of the truck bed and others have a rail much less than an inch thick at the same point. These different rail thicknesses can be accommodated by selecting the dimensions of one of the clamp extrusions accordingly.

While the clamp members have been referred to as "extrusions", it will be understood that they are only slices of elongated extrusions. However, one of the advantages of using extrusions as clamping members is that the clamping areas of both of the pressure pads can be made as large as desired simply by making the extrusion slices as thick as is required.

The exemplifications set out herein illustrate a preferred embodiment of the invention in one form thereof and such exemplifications are not to be construed as limiting the scope of the disclosure or the scope of the invention in any manner.

DETAILED DESCRIPTION OF SPECIFIC EMBODIMENTS OF THE INVENTION

Figure 1:
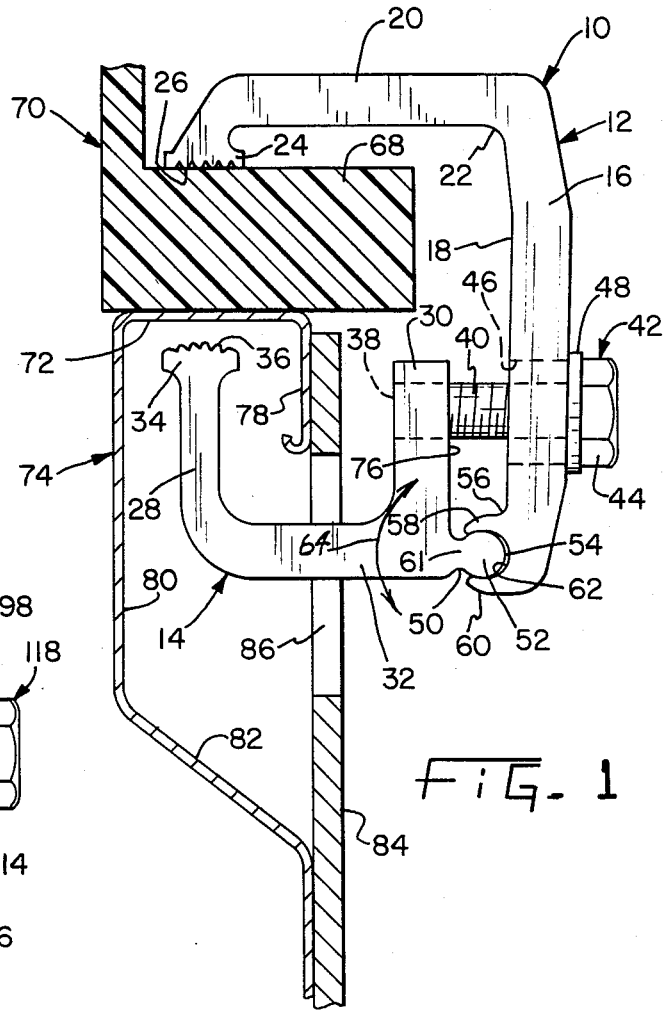
FIG. 1 is a side elevational view of a clamp incorporating the invention and a fragmentary part of a typical work piece gripped by the clamp.

Referring to the drawings and particularly to FIG. 1, a clamp 10 is formed of two extrusions 12 and 14. These extrusions are only short lengths, or slabs, of elongated extrusions of tempered aluminum or other extrudible material having the necessary properties of strength required to withstand the stresses imposed on a clamp. The extrusion 12 includes a body portion 16 that is basically flat and has an inner surface 18 that is substantially flat. As may be seen, neither the body portion 16 nor the surface 18 are precisely flat, but they are sufficiently so to meet the general description of flatness as referred to hereinafter. An arm 20 is extruded along one edge 22 of the body portion and extends from the body portion 16 out to an end at which a pressure pad 24 is located. In this embodiment, the pressure surface 26 of pad 24 is formed with serrations as shown.

The other extrusion 14 has a generally U-shaped configuration and consists of two sides 28 and 30 joined together by a bight portion 32 that, in this instance, is substantially flat. The sides 28 and 30 are also substantially flat in this embodiment so that the cross sectional configuration of the extrusion 14 is basically rectangular. A second pressure pad 34 is formed along the edge of the side 28 and has a gripping surface consisting of a series of ridges 36 extruded along a cylindrically convexly curved surface. The other side 30 has a threaded hole 38 into which the threaded shaft 40 of a bolt 42 is threadedly inserted. The bolt 42 has a head 44, and the shaft of the bolt extends through a clearance hole 46 in the body portion 16. While the clearance hole 46 is shown to be substantially wider than the shaft 40, it is, in fact, an elongated slot and is only a little wider in the direction perpendicular to the drawing than is the shaft 40. Since the head 44 of the bolt 42 is wider than the slot 46 in that direction, the head cannot pass through the slot. If desired, and in order to provide smoother operation, a washer 48 may be inserted between the head 44 and the body portion 16, and this washer may be made as large in diameter as is necessary to pervent the head of the bolt 44 from going through the clearance hole 46. In fact, the washer 48 may be considered to be part of the head of the bolt 42.

The extrusions 12 and 14 are held together by means of two retaining members in a manner that permits limited pivotal movement of one of the extrusions with respect to the other. One retaining member consists of a web 50 that extends from the extrusion 14 at approximately the location of the intersection of the side 30 and the bight 32 and has a bead 52 at its outer edge. It is preferable that the web 50 be substantially aligned with the bight 32 and that the bead 52 have a basically circular cross-section. In any case, the bead must have a diameter, or width, greater than the thickness of the web. The other retaining member is a channel 54 formed along the opposite edge 56 of the body portion 16 from the edge 22 along which the arm 20 is formed. The channel 54 is partly defined by two edge portions, which, in this embodiment, are relatively thin flaps 58 and 60 that extend outwardly from the body portion 16 and are curved toward each other so that a gap 61 between their edges is narrower than the width of the bead 52 but wider than the width of the web 50. The cross sectional configuration of the channel 54 is substantially circular like the bead 52 but of slightly larger radius so that the bead can slide easily longitudinally in the channel 54 but cannot be pulled transversely from the channel because of interference between the bead 52 and the somewhat narrower gap defined by the edge portions 58 and 60. In order that the body portion 16 not be weakened by the channel 54, it is preferable that the thickness of the body portion at the edge 56 not be reduced substantially, and, thus, it is desirable that the lowermost surface 62 of the channel be substantially coplanar with the inner surface 18 of the body portion 16.

It will be obvious that the bead 52 and the channel 54 allow some pivotal movement between the extrusions 12 and 14 as indicated by the arrow 64. The reason that the clearance hole 46 is formed as a slot is to accommodate the tilting motion of the bolt 42 that accompanies such pivotal movement of the extrusions relative to each. The side 30 of the extrusion 14 is made somewhat thicker than the side 28 to provide sufficient threaded engagement between the shaft 40 and the threaded hole 38 even if the bolt is loosened enough to increase the space between the pressure pads 24 and 34 to the maximum limit of the particular extrusions 12 and 14 used in the clamp 10. Furthermore, when the bolt 42 is tightened to cause the pressure pads 24 and 34 to engage the work piece firmly, stress will be created in the side 30 in a direction perpendicular to the thickness thereof. On the other hand, stress will be produced in the side 28 parallel to the thickness, which is another reason why the side 28 can be made somewhat thinner than the side 30.

The work piece with which the side 10 is illustrated in FIG. 1 is, itself, not a part of the invention, but it is the type of work piece with which the specific extrusions 12 and 14 are intended to operate. That is, the work piece includes a rail 68 of a truck cap 70 and the lip portion 72 of a truck bed 74. The particular rail illustrated is made of glass-fiber reinforced plastic and is about an inch thick and, as shown in FIG. 1, extends into the space between between the upper end of side 30 and arm 20. Other rails are made of aluminum and are substantially thinner than one inch, and when a clamp 10 is to be used with thinner rails, or with entirely different work pieces, it is preferable to use a different extrusion 12 having the same overall configuration but having a body portion 16 that has a smaller distance between the clearance hole 46 and the edge 22. It is desirable that, when the pressure pads 24 and 34 are in contact with the work piece, whatever the size of the work piece, the surface 76 of the side 30 of the extrusion 14 should be substantially parallel to the surface 18 of the body portion 16, and it is also desirable that the shaft 40 not extend substantially into the region between the sides 28 and 30 of the extrusion 14. Since the distance between the surfaces 18 and 76 of the juxtaposed members 16 and 30 is substantially equal to the overall length of the web 50 plus the head 52, as measured in the direction perpendicular to the side 30, the preferred length of the shaft 40 may be defined as not substantially greater than the total thicknesses of the body portion 16 and the sides 30 and the combined length of the web 50 and the bead 52.

The reason for wishing to have the shaft 40 not extend substantially into the region between the sides 28 and 30 is that it is common for the work piece to extend into this region. In the example illustrated, the lip 72 of the truck bed has a downturned flange 78 that extends deeply into the gap between the sides 28 and 30.

One of the advantages of the clamp 10 is that it can be used in situations in which a standard C-clamp cannot be used. A standard C-clamp has a generally C-shaped configuration with a fixed pressure pad on one cusp of the C and with an elongated threaded rod extending through the other cusp in juxtaposition with the fixed pressure pad. The threaded rod is commonly provided with a transverse handle at its end to provide enough leverage to rotate the threaded rod to bring the movable pressure pad at its other end firmly into engagement with the work piece to grip the work piece between that movable pressure pad and the fixed pressure pad. If an attempt were made to use a standard C-clamp to hold the truck cap rail 68 in FIG. 1 on the lip 72, with the fixed pressure pad at the location of the pressure pad 24, the movable pressure pad would be at the location of the pressure pad 34, but since the movable pressure pad of a standard C-clamp is directly in line with the threaded rod on which it is mounted, the transverse handle on that rod would interfere with the truck bed 74 due to interference between the handle and the side wall 80. It is also possible that the threaded rod could be too long to fit in the region between the lip 72 and the inwardly extending part 82 of the truck bed 74. Even if a standard C-clamp were inserted upside down so that its fixed pressure pad occupied the position of the pressure pad 36 in FIG. 1, the handle on the end of the threaded rod would interfere with the truck cap 70. In the clamp 10, the fact that the axis of the bolt 42 is perpendicular to the axis of the normal adjustable threaded rod in a standard C-clamp is advantageous in that it places the head 44 of the bolt in a position where it is easily accessible by a wrench.

There is still another advantage in the use of a clamp, such as the clamp **10*a*, to hold the truck cap 70*a* on the lip 72 of the truck bed 74. Truck owners frequently use a plastic liner 84 on the inside of the truck bed 74 to keep the bed from being scuffed or rusted. The clamp 10 can still be used to hold the truck cap 70 on the bed 74 even if there is a liner 84. All that is required is that a relatively small opening 86 be formed in the liner 84 to allow the side 28 of the extrusion 14 to be inserted through it and into position under the lip 72**.

Figure 2:
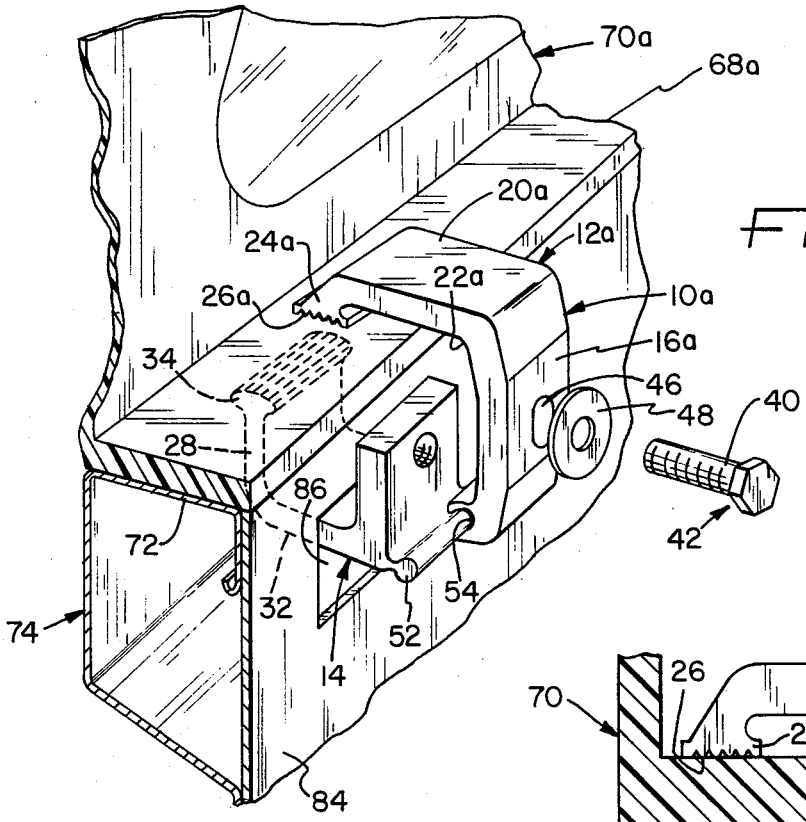
FIG. 2 is a perspective view of a clamp substantially like that in FIG. 1 in the process of being assembled with a fragment of a truck bed and truck cap.

Reference will now be made to FIG. 2 in which parts identical to those in FIG. 1 will be identified by the same reference numerals, and those that differ in dimension will be identified by the same reference numeral with the suffix a. FIG. 2 shows the clamp **10*a* being assembled on a truck cap 70*a* that differs from the truck cap 70 in FIG. 1 by having a thinner aluminum rail 68*a* that may be only about ¼" thick. As a result the distance between the pressure pads 24*a* and 34 of the clamp 10*a* should be spaced accordingly, which is achieved by reducing the length of the body portion 16*a* of the clamp 10*a* and, specifically, by reducing the distance between the edge 22*a* and the clearance hole 46. Another difference is that, in FIG. 2, the pressure pad 24*a* has serrations arranged on a planar surface. This helps distribute the pressure over a greater area of the upper surface of the work piece, which in this instance, is the upper surface of the truck cap rail 68*a*. The length of the arm 20*a* in FIG. 2 is still the same as the distance from the body portion 16*a* to the center of the pressure pad 24*a*, which 2 is substantially the same as the distance from the body portion 16*a* to the remote edge of the bight 32 where that bight joins the side 28**.

As shown in FIG. 2, the side 28 and part of the bight 32 of the extrusion 14 have been inserted through the opening 86 in the bed liner 84, and the extrusion **12*a* is being assembled with the extrusion 14 by sliding the channel 54 longitudinally over the bead 52. After the extrusions 12*a* and 14 have been placed completely in alignment with each other, the shaft 40 of the bolt 42 can be inserted through the washer 48 and through the clearance hole 46 and can be threaded into the threaded hole 38 in the side 30 and tightened sufficiently to press the cap rail 68*a* firmly against the lip 72**.

Figure 3:
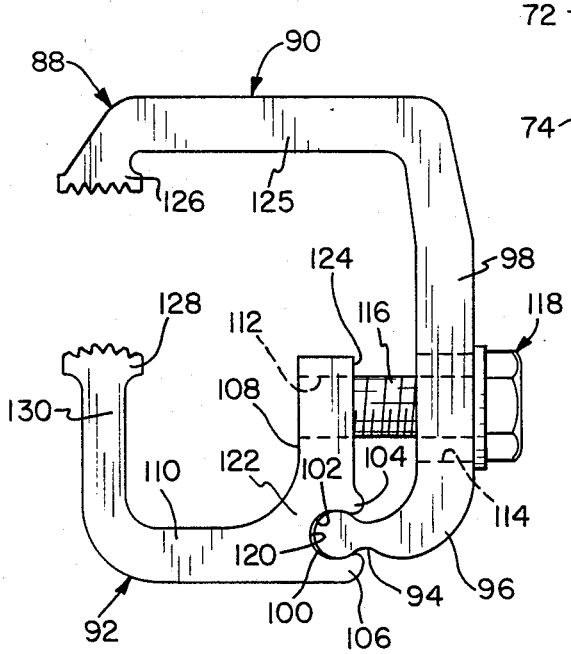
FIG. 3 is a side elevational view of a modified embodiment of the clamp in FIG. 1.

FIG. 3 shows a modified clamp 88 generally similar to the clamp 10 in FIG. 1 except that the retaining members are reversed. The clamp 88 includes two extrusions 90 and 92. The first extrusion 90 has a web 94 extending from one edge 96 of the body portion 98 and terminating in a bead 100 of generally circular cross section. The second extrusion 92 is of generally U-shaped cross-section and has a channel 102 of generally circular cross section with a slightly larger diameter than the bead 100 to allow the bead to slide freely in the channel during assembly of the clamp 88. In this embodiment, the channel 102 is partly defined by edge portions 104 and 106 of the extrusion and is shown as being an extruded recess in the second extrusion 92 at the intersection of one side 108 and the bight 110.

The side 108 has a threaded hole 112 in line with a clearance slot 114 to receive the threaded shaft 116 of a bolt 118. Although the bolt pulls the bead 100 against the bottom 120 of the channel 102 when the clamp 88 is tightened on a work piece, which is desirable in that the stress induced by the bolt 118 does not tend to spread the edge portions 104 and 106 apart nor to subject the web 94 to tensile stress, the fact that the channel is within the perimeter of the extrusion 92 does tend to weaken that extrusion due to the reduced cross section at the intersection 122 of the side 108 and the bight 110. For that reason, the embodiments in FIGS. 1 and 2 are to be preferred over that in FIG. 3. However, the channel 102 could be defined by flaps extending outwardly from the side 108 with the bottom 120 of the channel 102 substantially coplanar with the surface 124 of the side 108. Then the cross section of the intersection 122 would not be weakened.

As in the previously described embodiments, the extrusion 90 has an arm 125 extending from the body portion 98 and provided with a pressure pad 126 at its outer end. A pressure pad 128 is extruded along the edge of the side 130 of second extrusion and is located substantially directly in line with the pressure pad 128.

While there have been described above the principles of this invention in connection with specific apparatus, it is to be clearly understood that this description is made only by way of example and not as a limitation to the scope of the invention.

What is claimed is:

1. An adjustable clamp comprising:

a first extrusion comprising a body portion with a hole therethrough, an arm extruded along one edge of the body portion extending substantially perpendicular therefrom, and a first pressure pad on the arm;

a U-shaped second extrusion comprising a first side, a second side with a hole therethrough, a bight joining the first side to the second side, and a second pressure pad on the first side facing the first pressure pad;

a retaining structure comprising a first retaining member comprising a surface portion extruded along the body portion of the first extrusion adjacent the edge of the body portion remote from the arm, and a second retaining member extruded along the second extrusion, the second retaining member comprising an integrally extruded web terminating in an integrally extruded bead of greater thickness than the thickness of the web, the web of the second retaining member extending from the second extrusion near the intersection of the second side and the bight and substantially perpendicular to the second side, the other retaining member comprising a pair of integrally extruded portions partially enclosing a channel of larger cross-sectional size than the bead, the integrally extruded portions extending partially together and defining therebetween a gap having a width that is greater than the thickness of the web and less than the thickness of the bead, whereby the bead can be inserted lengthwise into the channel to join the first and second members together, the body portion and the second side thereby comprising juxtaposed members with said second side extending substantially perpendicular to said arm with the end of said second side being spaced from said arm thereby to provide a space for receiving a workpiece and the hole through the body portion being in alignment with the hole through the second side, the hole through the body portion being a clearance hole located between the first retaining member and the arm and the other of said holes being threaded and located in the second side of the second extrusion, the body portion of the first extrusion facing the second side of the second extrusion being generally flat and substantially coplanar with the deepest part of the channel;

a bolt comprising a head and a threaded shaft extending through the clearance hole and threadedly engaging the threaded hole to urge the juxtaposed members toward each other, whereby the first and second extrusions pivot relatively to each other about the bead, said arm of said first extrusion and said second side being transversely located and separated.

2. An adjustable clamp comprising:

a first extrusion comprising a body portion with a hole therethrough, an arm extruded along one edge of the body portion extending substantially perpendicular therefrom, and a first pressure pad on the arm;

a U-shaped second extrusion comprising a first side, a second side with a hole therethrough, a bight joining the first side to the second side, and a second pressure pad on the first side facing the first pressure pad;

a retaining structure comprising a first retaining member comprising a surface portion extruded along the body portion of the first extrusion adjacent the edge of the body portion remote from the arm, and a second retaining member extruded along the second extrusion, the first retaining member comprising an integrally extruded web terminating in an integrally extruded bead of greater thickness than the thickness of the web, the web of the first retaining member extending from the first extrusion near the end of the body portion remote from the arm and substantially perpendicular to the body portion, the other retaining member comprising a pair of integrally extruded portions partially enclosing a channel of larger cross-sectional size than the bead, the integrally extruded portions extending partially together and defining therebetween a gap having a width that is greater than the thickness of the web and less than the thickness of the bead, whereby the bead can be inserted lengthwise into the channel to join the first and second members together, the body portion and the second side thereby comprising juxtaposed members with said second side extending substantially perpendicular to said arm with the end of said second side being spaced from said arm thereby to provide a space for receiving a workpiece and the hole through the body portion being in alignment with the hole through the second side, the hole through the body portion being a clearance hole located between the first retaining member and the arm and the other of said holes being threaded and located in the second side of the second extrusion, the body portion of the first extrusion facing the second side of the second extrusion being generally flat;

a bolt comprising a head and a threaded shaft extending through the clearance hole and threadedly engaging the threaded hole to urge the juxtaposed members toward each other, whereby the first and second extrusions pivot relatively to each other about the bead, said arm of said first extrusion and said second side being transversely located and separated.

* * * * *